US011135851B2

(12) United States Patent
Ujiie

(10) Patent No.: US 11,135,851 B2
(45) Date of Patent: Oct. 5, 2021

(54) WIPER AND WIPER MECHANISM

(71) Applicant: RISO KAGAKU CORPORATION, Tokyo (JP)

(72) Inventor: Hideyuki Ujiie, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/854,998

(22) Filed: Apr. 22, 2020

(65) Prior Publication Data

US 2020/0376844 A1 Dec. 3, 2020

(30) Foreign Application Priority Data

May 30, 2019 (JP) ..... JP2019-100939

(51) Int. Cl.
*B41J 2/165* (2006.01)

(52) U.S. Cl.
CPC ..... *B41J 2/16535* (2013.01); *B41J 2/16538* (2013.01); *B41J 2/16544* (2013.01); *B41J 2/16585* (2013.01); *B41J 2002/16591* (2013.01)

(58) Field of Classification Search
CPC ..... B41J 2/16535; B41J 2/16544; B41J 2/16538; B41J 2/16585; B41J 2002/16591
See application file for complete search history.

(56) References Cited

U.S. PATENT DOCUMENTS 6,305,282 B1 * 10/2001 Datwyler ..... B41F 9/1072 101/154
2013/0208048 A1 * 8/2013 Kritchman ..... B41J 2/16535 347/32

FOREIGN PATENT DOCUMENTS

JP 10-235883 9/1998

* cited by examiner

*Primary Examiner* — Geoffrey S Mruk
(74) *Attorney, Agent, or Firm* — Greenblum & Bernstein, P.L.C.

(57) ABSTRACT

A wiper that extends toward an inkjet head and wipes a nozzle surface of the inkjet head includes: a base section extending in an extension direction of the wiper, an inclined surface continuous with the base section and having, in a direction in which the wiper travels during wiping, a thickness that gradually decreases toward the extension direction; and a leading-end projecting section thinner than the base section and provided at a leading end of the wiper in such a manner as to be continuous with the inclined surface and project in the extension direction.

12 Claims, 11 Drawing Sheets

DURABILITY TEST OF NOZZLE SURFACE

| | | LEADING-END-PORTION LENGTH (LENGTH B) [mm] | | | | | | | | |
|---|---|---|---|---|---|---|---|---|---|---|
| | | 0.02 | 0.05 | 0.1 | 0.13 | 0.15 | 0.18 | 0.19 | 0.2 | 0.3 |
| LEADING-END-PORTION THICKNESS (THICKNESS A) [mm] | 0.03 | | | △ (0.30) | | | | | | △ (0.10) |
| | 0.04 | ○ (2.00) | | | | | | | | △ (0.13) |
| | 0.05 | ○ (2.50) | | | ○ (0.38) | | | △ (0.26) | | △ (0.17) |
| | 0.06 | ○ (3.00) | ○ (1.20) | ○ (0.60) | | ○ (0.40) | | | | △ (0.20) |
| | 0.07 | ○ (3.50) | | | | ○ (0.47) | ○ (0.39) | | ○ (0.35) | △ (0.23) |
| | 0.09 | | ○ (1.80) | ○ (0.90) | | | | | | |
| | 0.1 | | ○ (2.00) | ○ (1.00) | | | | | | |
| | 0.12 | | ○ (2.40) | ○ (1.20) | | | ○ (0.67) | | | |
| | 0.14 | | | | | | ○ (0.78) | | | |
| | 0.17 | ○ (8.50) | | | | | | | | |

FIG. 9

WIPER AND WIPER MECHANISM

CROSS-REFERENCE TO RELATED APPLICATION

This application is based upon and claims the benefit of priority of the prior Japanese Patent Application No. 2019-100939, filed on May 30, 2019, the entire contents of which are incorporated here in by reference.

FIELD

The aspects described herein are related to a wiper for wiping the nozzle surfaces of inkjet heads and a wiper mechanism that includes this wiper.

BACKGROUND

Inkjet printing apparatuses that discharge ink from the nozzles of inkjet heads on the basis of print data have conventionally been such that paper powder, dust, or the like from sheets could be deposited on the nozzle surfaces of the inkjet heads while performing a printing operation. Deposition of paper powder, dust, or the like on a nozzle surface could lead to an occurrence of a discharging failure such as non-discharging or deviation of a direction in which ink is discharged from the nozzle, thereby reducing the quality of images printed on the sheet.

Accordingly, a known inkjet printing apparatus includes a wiper for wiping the nozzle surfaces of inkjet heads, wherein the nozzle surfaces are wiped by the wiper after purge ink is forcibly discharged, so as to reduce a failure of discharge of ink from the nozzle. As such a wiper, a wiper is known that is, for example, provided with, at a leading-end portion thereof, an inclined surface having, in a direction in which the wiper travels, a thickness that gradually decreases toward an extension direction (e.g., Japanese Laid-open Patent Publication No. 10-235883).

SUMMARY

A wiper in one aspect is a wiper that extends toward an inkjet head and wipes a nozzle surface of the inkjet head, the wiper including: a base section extending in an extension direction of the wiper; an inclined surface continuous with the base section and having, in a direction in which the wiper travels during wiping, a thickness that gradually decreases toward the extension direction; and a leading-end projecting section thinner than the base section and provided at a leading end of the wiper in such a manner as to be continuous with the inclined surface and project in the extension direction. The object and advantages of the present invention will be realized by the elements recited in the claims or combinations thereof.

BRIEF DESCRIPTION OF DRAWINGS

FIG. 9 is a table illustrating a result of a durability test of a nozzle surface for various sizes of a leading-end projecting section in an embodiment;

DESCRIPTION OF EMBODIMENTS

Figure 1:
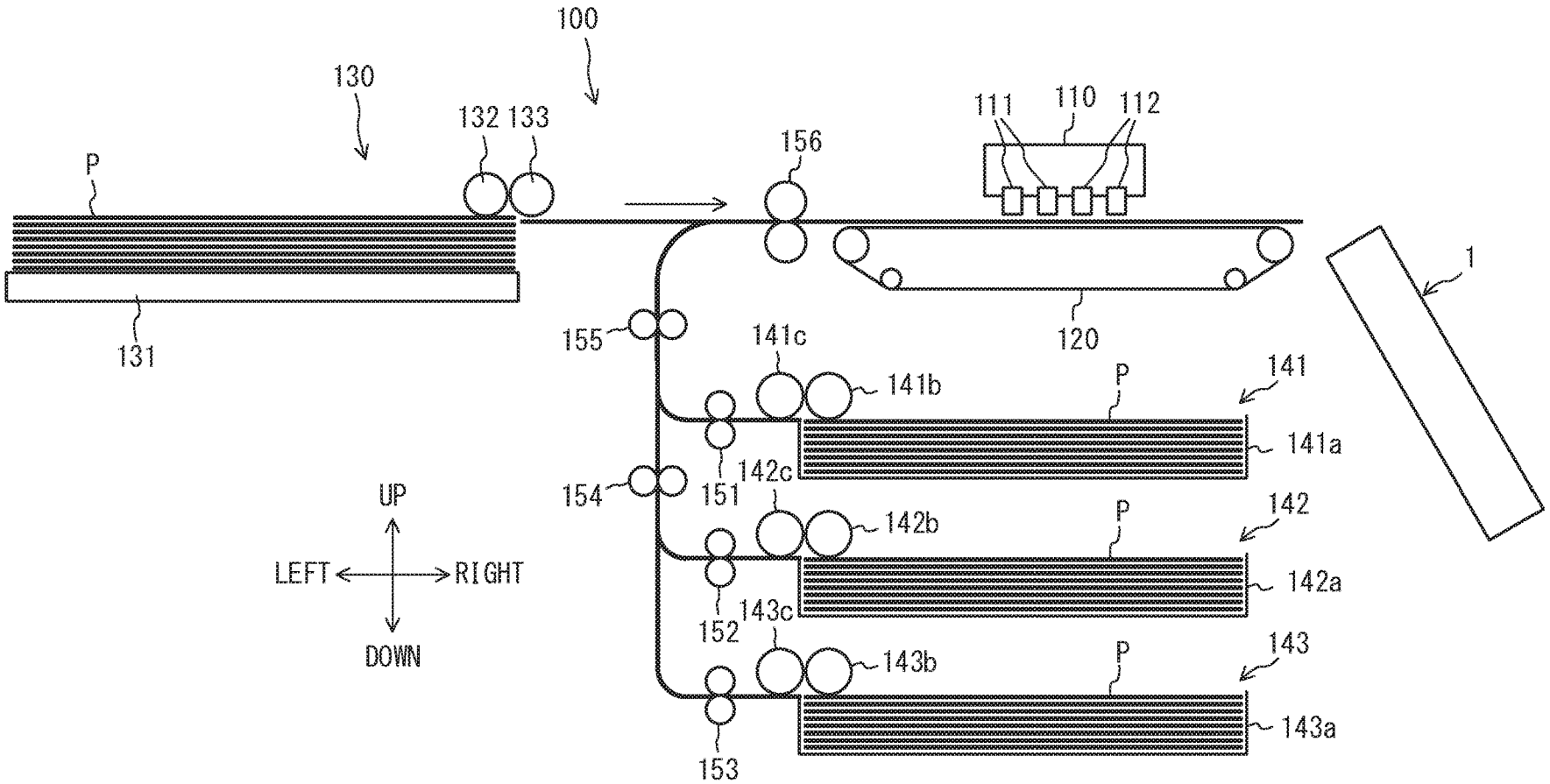
FIG. 1 is a configuration diagram illustrating an inkjet printing apparatus in an embodiment.

In the meantime, with the improvement of the quality of printed images in recent years, ink has become dense, and nozzle holes have been downsized (higher definition has been achieved). The dense ink provides high concentrations of ink pigments and additives to serve as polishing agents, thereby promoting wearing of nozzle surfaces (ink-repellent films) due to wiping, with the result that it has been difficult to ensure the durability of the nozzle surfaces. When nozzle holes are formed through, for example, laser processing to ensure the accuracy in the shapes thereof, it will be necessary to make thin the nozzle surfaces (nozzle plates) and ink-repellent films with which the nozzle surfaces are coated, and this will also make it difficult to ensure the durability of the nozzle surfaces.

A wiper provided with, as described above, an inclined surface at the leading end thereof has a thickness gradually decreased toward the leading end and thus can reduce a pressure of abutment between the wiper and the nozzle surface; however, as the durability is decreased toward the leading end, there tend to be variations in abutment pressures (contact pressure) and contact states (contact pressure distribution) on a region of abutment between the wiper and the nozzle surface. Thus, purge ink discharged before wiping does not evenly spread, and the wiper is poorly slid on the nozzle surface due to very thin portions of a layer of purge ink or portions without purge ink, with the result that so-called chattering occurs wherein the wiper is caught on the nozzle surface and vibrates. Thus, uneven wear resulting from chattering occurs on the nozzle surface in a width direction orthogonal to the traveling direction of the wiper (thickness direction). In addition, due to variations in abutment pressures and contact states, uneven wear could occur in streaks parallel to the traveling direction of the wiper.

The following describes a wiper and a wiper mechanism in accordance with embodiments of the present invention by referring to the drawings.

FIG. 1 is a configuration diagram illustrating an inkjet printing apparatus 100 in an embodiment.

Figure 2:
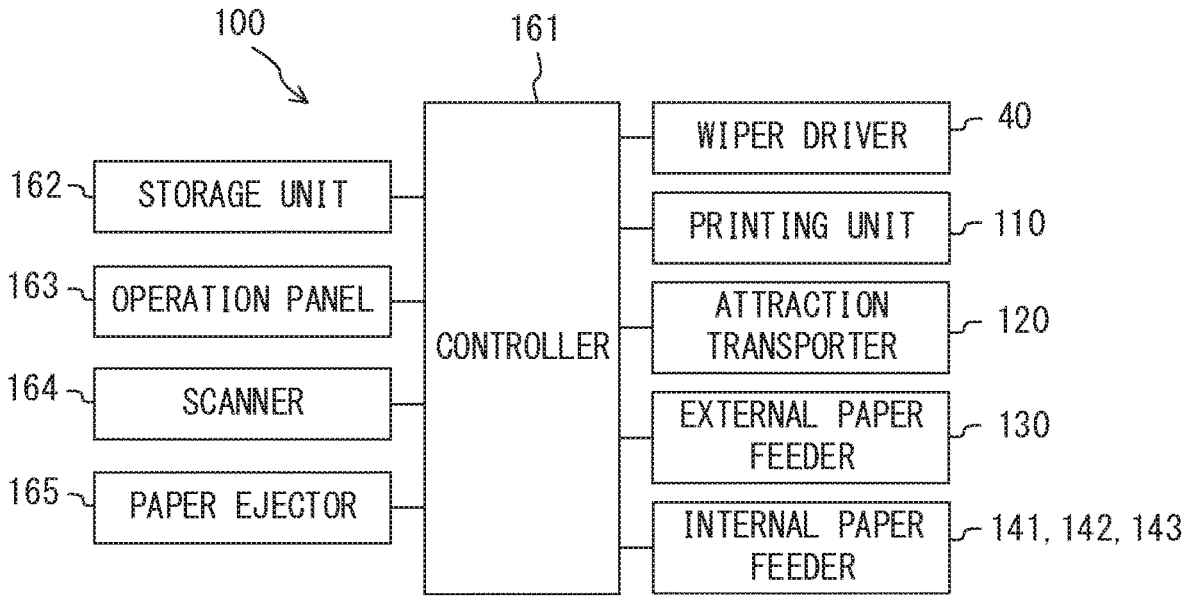
FIG. 2 is a control configuration diagram illustrating an inkjet printing apparatus in an embodiment.

FIG. 2 is a control configuration diagram illustrating the inkjet printing apparatus 100.

The front-rear direction, up-down direction, and left-right direction indicated in FIG. 1 and FIGS. 3-8, 10, and 11, which will be described hereinafter, are merely examples for which a direction in which a sheet P is transported is defined as a right direction. For example, the front-rear direction and the left-right direction may each be a horizontal direction, and the up-down direction may be a vertical direction.

As depicted in FIG. 1, the inkjet printing apparatus 100 includes a wiper mechanism 1, a printing unit 110, an attraction transporter 120, an external paper feeder 130, internal paper feeders 141-143, transportation roller pairs 151-155, and a paper-stop-roller pair 156. As depicted in FIG. 2, the inkjet printing apparatus 100 includes a controller 161, a storage unit 162, an operation panel 163, a scanner 164, and a paper ejector 165. Thick solid lines in FIG. 1 indicate transportation paths from the external paper feeder 130 and the internal paper feeders 141-143 to the printing unit 110.

Figure 3:
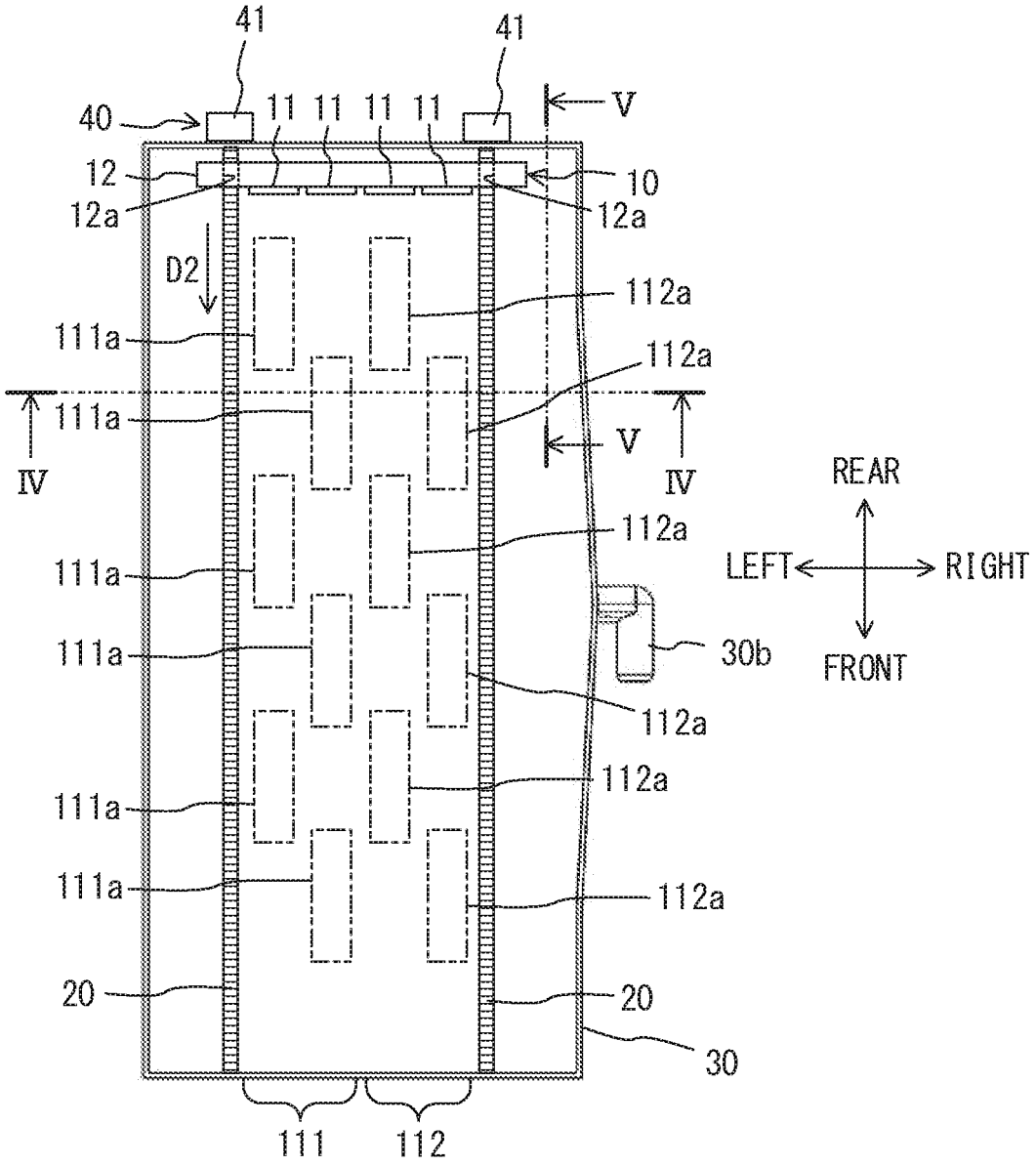
FIG. 3 is a plan view illustrating a wiper mechanism in accordance with an embodiment.

For example, the printing unit 110 may include two inkjet heads 111 and 112. As depicted in FIG. 3, the inkjet heads 111 and 112 respectively include six (a plurality of) head modules 111*a* and six (a plurality of) head modules 112*a* staggered along a main scanning direction (front-rear direction) orthogonal to a direction (right direction) in which a sheet P is transported. Accordingly, the six head modules 111*a* and the six head modules 112*a* of the inkjet heads 111 and 112 that are arranged in the front-rear direction are located at different positions in the left-right direction. In one example, the six head modules 111*a* of the one inkjet head 111 discharge inks of two colors (e.g., black (K) and cyan (C)), and the six head modules 112*a* of the other inkjet head 112 discharge inks of two colors (e.g., magenta (M) and yellow (Y) different from the colors provided by the inkjet head 111.

The attraction transporter 120 faces the printing unit 110. For example, the transporter 120 may transport a sheet P by means of a transportation belt while attracting the sheet P. The attraction transporter 120 can move to a printing position depicted in FIG. 1, a wiping position depicted in FIG. 6 below the printing position, and a standby position (not illustrated) below the wiping position. The wiper mechanism 1 in a printing operation depicted in FIG. 1 is located at a position retracted from a position below the printing unit 110.

The external paper feeder 130 and the internal paper feeders 141-143 include paper feeding trays 131, 141*a*, 142*a*, and 143*a*, scraper rollers 132, 141*b*, 142*b*, and 143*b*, and pickup rollers 133, 141*c*, 142*c*, and 143*c*.

A plurality of sheets P are placed on the paper feeding trays 131, 141*a*, 142*a*, and 143*a*.

The scraper rollers 132, 141*b*, 142*b*, and 143*b* are drawing-out rollers for drawing out and transporting uppermost sheets P among the plurality of sheets P placed on the paper feeding trays 131, 141*a*, 142*a*, and 143*a*.

The pickup rollers 133, 141*c*, 142*c*, and 143*c* transport sheets P drawn out by the scraper rollers 132, 141*b*, 142*b*, and 143*b*.

The transportation roller pairs 151-155 are disposed on transportation paths from the internal paper feeders 141-143 to the paper-stop-roller pair 156.

Sheets P transported from the external paper feeder 130 and the internal paper feeders 141-143 abut the paper-stop-roller pair 156. Thus, skew of sheets P is corrected.

The controller 161 depicted in FIG. 2 includes a processor (e.g., central processing unit (CPU)) for functioning as an arithmetic processing apparatus for controlling the operations of the entirety of the inkjet printing apparatus 100 and controls the operations of components of the inkjet printing apparatus 100 such as a wiper driver 40, the printing unit 110, and the attraction transporter 120.

For example, the storage unit 162 may be a read only memory (ROM) that is a read-only semiconductor memory having a predetermined control program recorded therein in advance, a random access memory (RAM) that is a randomly writable/readable semiconductor memory used as a working storage region on an as-needed basis when a processor executes various control programs, or a hard disk apparatus.

The operation panel 163 includes an operation key and a touch panel for performing various operations, a display for displaying various information, and the like so as to function as examples of an input unit and a display of the inkjet printing apparatus 100.

The scanner 164 reads image data from a draft.

The paper ejector 165 includes: a paper ejection tray on which sheets P for which the printing unit 110 has performed printing are placed; and an ejection roller for ejecting a sheet P onto the paper ejection tray.

FIG. 3 is a plan view illustrating the wiper mechanism 1.

Figure 4:
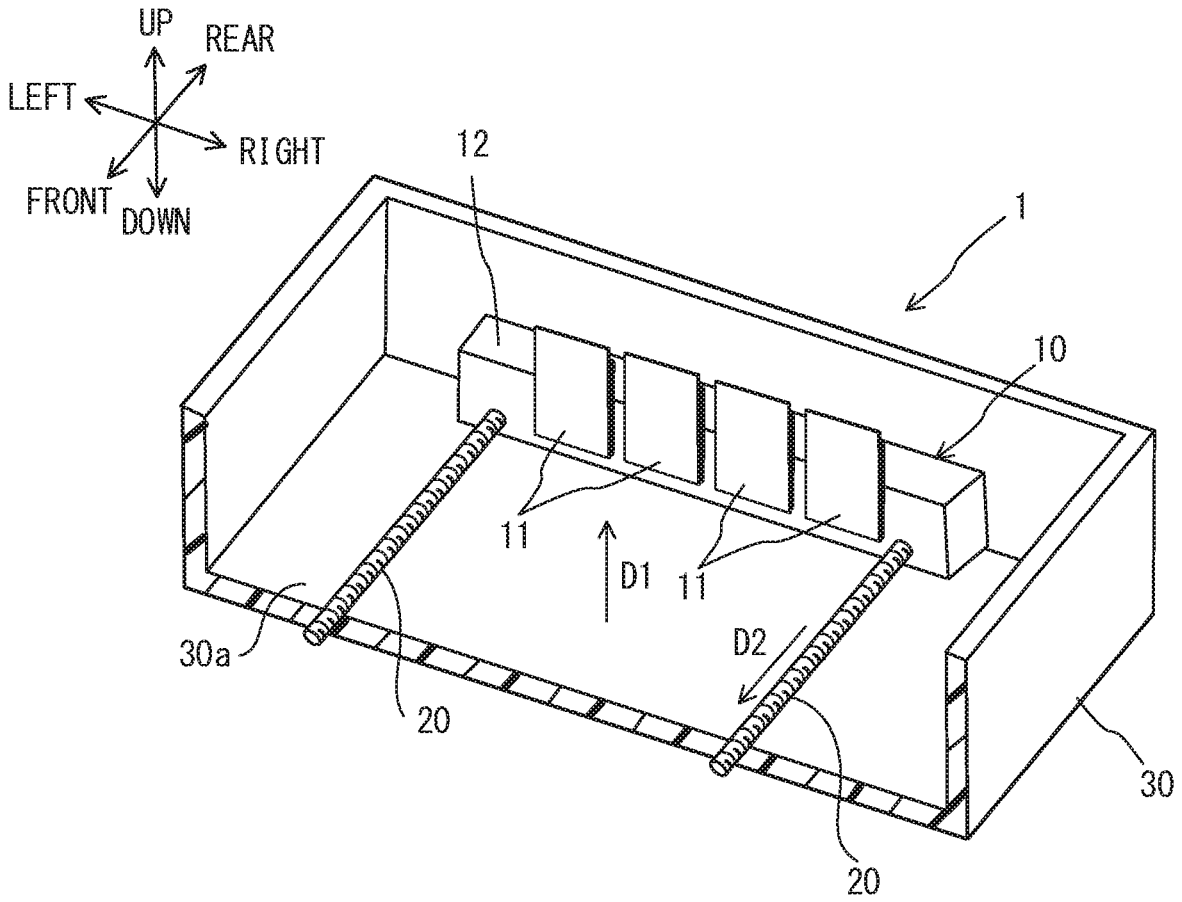
FIG. 4 is a perspective view illustrating a IV-IV cross section of FIG. 3 with head modules omitted.

FIG. 4 is a perspective view illustrating a IV-IV cross section of FIG. 3 with the head modules 111*a* and 112*a* omitted.

Figure 5:
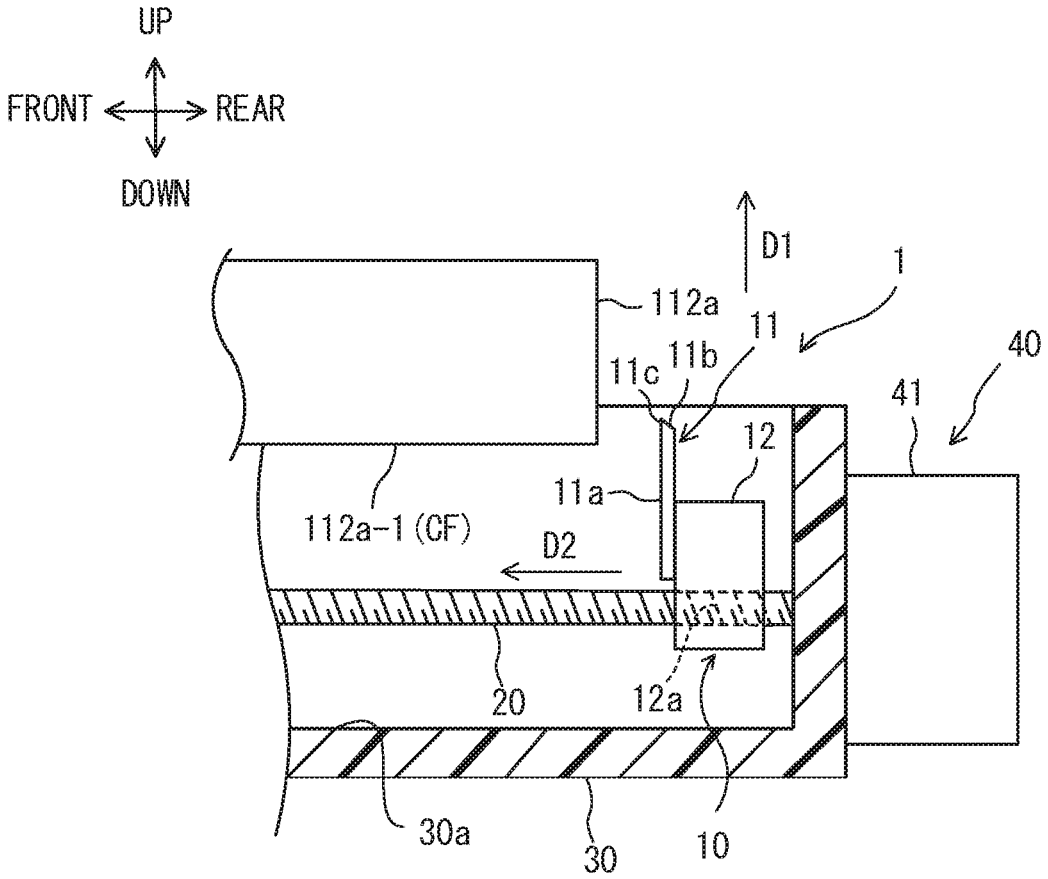
FIG. 5 is a V-V cross-sectional view of FIG. 3.

FIG. 5 is a V-V cross-sectional view of FIG. 3.

Figure 6:
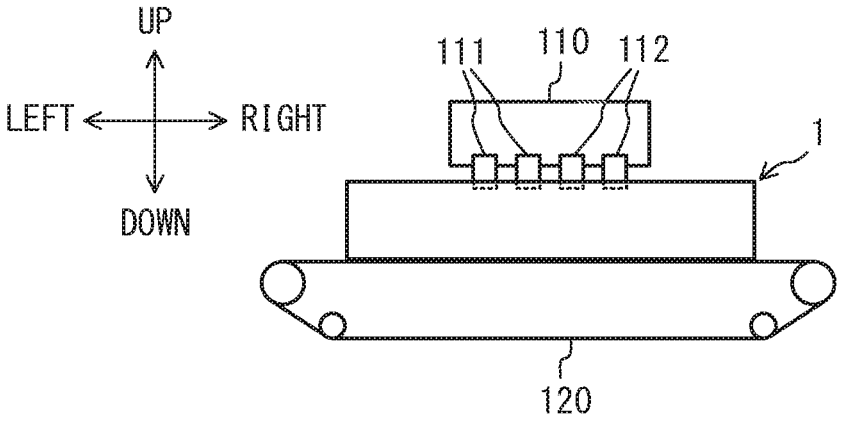
FIG. 6 is an explanatory diagram illustrating a wiper mechanism located at a wiping position in an embodiment.

FIG. 6 is an explanatory diagram illustrating the wiper mechanism 1 located at a wiping position.

Figure 7:
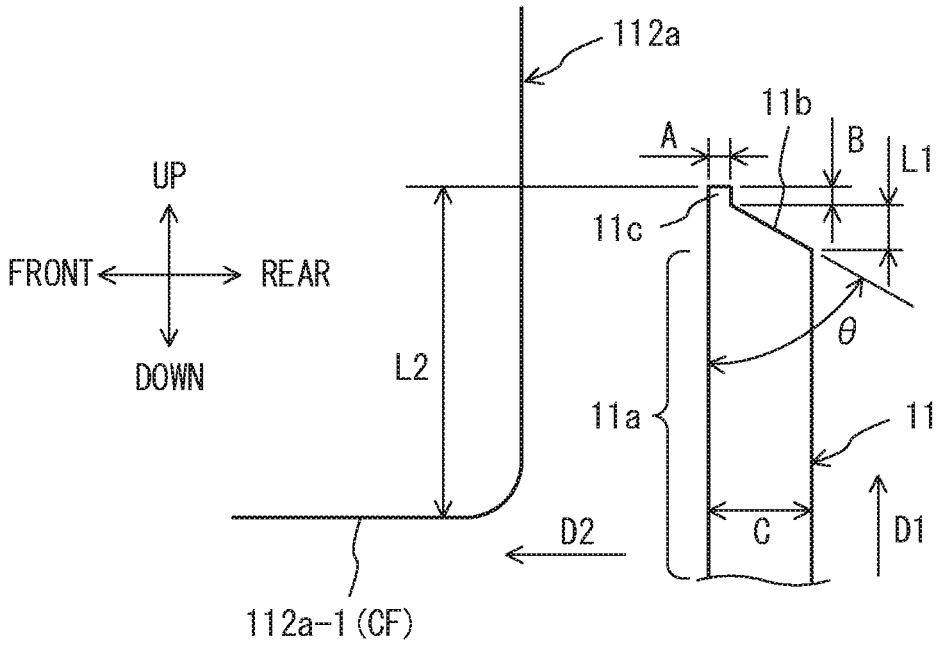
FIG. 7 is an explanatory diagram illustrating the size of a wiper in accordance with an embodiment.

FIG. 7 is an explanatory diagram illustrating the size of a wiper 11.

The front-rear direction, the up-down direction, and the left-right direction indicated in FIGS. 3-5 and 7 are directions achieved when the wiper mechanism 1 is located at a wiping position between the printing unit 110 and the attraction transporter 120 as depicted in FIG. 6.

The wiper mechanism 1 includes a wiper unit 10, two guides 20, an ink receiver 30, and a wiper driver 40.

For example, the wiper unit 10 may include four wipers 11 and a wiper supporting member 12 for supporting the wipers 11.

The head modules 111*a* and 112*a* of the two inkjet heads 111 and 112 are staggered in four lines arranged in the left-right direction as described above, and the four wipers 11 are disposed to each wipe nozzle surfaces 112*a*-1 of one line of (three) head modules 111*a* or 112*a* (only the nozzle surface 112*a*-1 of a head module 112*a* is depicted in FIGS. 5 and 7). Note that the nozzle surfaces 112*a*-1 are coated with an ink-repellent film CF.

The wipers 11 extend in an extension direction D1, i.e., upward, toward the head modules 111*a* and 112*a* (inkjet heads 111 and 112) and wipe the nozzle surfaces 112*a*-1. The wipers 11 are elastic bodies elastically deformed when abutting the head module 111*a* or 112*a* (nozzle surface 112*a*-1). The wiper 11 may comprise a material such as rubber, and an example of such a material may be the fluororubber of the "SFM-50L" (hardness: 52) provided by Sumitomo 3M limited. The hardness of the wiper 11 may be, for example, 55 or less to make even the pressure of abutment (described hereinafter) between the wiper 11 and the nozzle surface 112*a*-1.

For example, as depicted in FIG. 7, the wiper 11 may be shaped like a rectangular plate and include a base section 11*a*, an inclined surface 11*b*, and a leading-end projecting section 11*c*, which are continuous and arranged in the extension direction D1.

The base section 11*a* extends in the extension direction D1 of the wiper 11. For example, a thickness C that the base section 11*a* has in a traveling direction D2 (frontward) during the wiping by the wiper 11 may be constant (e.g., 0.55 mm) in the extension direction D1.

The inclined surface 11*b* is a flat section having a width in the traveling direction D2 (front direction) that is gradually decreased in the extension direction D1 (decreased from thickness C to thickness A). The inclined surface 11*b* may form an angle θ with the extension direction D1 that is equal to or greater than 45° but less than 90°. The inclined surface lib is provided at a rear portion of the wiper 11 in the traveling direction D2. A length of the inclined surface 11*b* in the extension direction D1 is L1 (e.g., 0.25 mm).

The leading-end projecting section 11*c* is provided at the leading end of the wiper 11 so as to project in the extension direction D1 from the front edge in the traveling direction D2, i.e., from the leading end of the inclined surface 1*b*. The thickness A (e.g., 0.12 mm) of the leading-end projecting section 11*c* in the traveling direction D2 is less than the thickness C of the base section 11*a*. For example, the thickness A may be constant in the extension direction D1. As will be described in detail hereinafter, a relationship of "A/B≥0.35" may be satisfied, where B (e.g., 0.1 mm) is the length of the leading-end projecting section 11*c*, in the extension direction D1.

The leading end of the wiper 11 before wiping is located at a position higher than the nozzle surfaces 112*a*-1 of the head modules 111*a* and 112*a* in the extension direction D1 by a length 12 (e.g., 1.8 mm). Accordingly, the wiper 11 moves in the traveling direction D2 toward the head modules 111*a* and 112*a* while overlapping these modules by the length L2.

As depicted in FIG. 4, four wipers 11 are attached to the wiper supporting member 12. For example, a pair of right and left screw holes 12*a* may extend through the wiper supporting member 12 in the front-rear direction.

The two guides 20*a* are, for example, screw shafts extending in the front-rear direction through the screw holes 12*a* of the wiper supporting member 12. Thus, the wiper unit 10 can move in the front rear direction in accordance with the guides 20 being rotated.

The ink receiver 30 receives ink (purge ink PI) that drops from the nozzle surfaces 112*a*-1 of the head modules 111*a* and 112*a* due to wiping by the wiper 11 together with paper powder, dust, or the like. In accordance with the wiper mechanism 1 being inclined at a retracted position depicted in FIG. 1, the ink in the ink receiver 30 may flow from a discharge section 30*b* of the ink receiver 30 depicted in FIG. 3 into a waste liquid storage via a waste liquid path. For example, the ink receiver 30 may be shaped like a rectangular solid having an opening facing upward. Thus, an inner bottom surface of the ink receiver 30 serves as an ink reception surface 30*a*. The ink receiver 30 supports front ends of the guides 20 in a rotatable manner.

For example, the wiper driver 40 may include two motors 41.

The motors 41 are examples of actuators and are, for example, coupled to the guides 20 by means of an adhesive strength. A single motor 41 may rotate, for example, a driving belt so as to cause the two guides 20 to rotate via a pulley provided within the driving belt. Alternatively, only a single motor 41 and a single guide 20 may be disposed, and this single guide 20 may move the wiper unit 10 in the front-rear direction.

Figure 8:
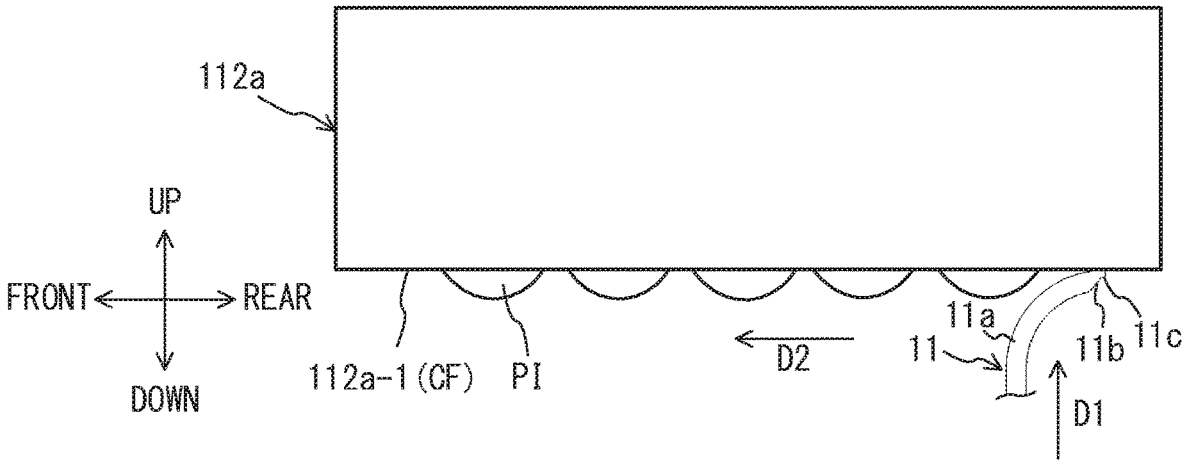
FIG. 8 is an explanatory diagram illustrating a wiper during wiping in an embodiment.

FIG. 8 is an explanatory diagram illustrating the wiper 11 during wiping.

Before the wiper 11 wipes the nozzle surfaces 112*a*-1 of the head modules 111*a* and 112*a* as depicted in FIG. 8, the attraction transporter 120 moves to a position below the printing position depicted in FIG. 1, and the wiper mechanism 1 moves to a position between the printing unit 110 and the attraction transporter 120, as depicted in FIG. 6. The head modules 111*a* and 112*a* discharge purge ink PI. Accordingly, the purge ink PI discharged from a plurality of nozzles are scattered and reach a plurality of points.

The wiper 11 moves in the traveling direction D2 while, as described above, being located above the nozzle surfaces 112*a*-1 of the head modules 111*a* and 112*a* in the extension direction D1 and overlapping these head modules (by the overlapping length L2 depicted in FIG. 7). Accordingly, the wiper 11 moves in the traveling direction D2 with a leading end portion thereof warped backward in the traveling direction D2. In this case, the leading-end projecting section 11*c*, among the other sections of the wiper 11, may abut the nozzle surface 112*a*-1 (ink-repellent film CF); and preferably a line-like abutment region (minute surface) of the wiper 11 abuts (comes in line-contact with) the nozzle surface 112*a*-1. The wiper 11 wiping the nozzle surface 112*a*-1 causes the purge ink PI to drop on the ink reception surface 30*a* of the ink receiver 30 together with paper powder, dust, or the like.

After the wiper 11 has wiped the nozzle surfaces 112*a*-1 of all of the head modules 111*a* and 112*a*, mixing of ink colors at nozzles can be improved through a flushing operation wherein the head modules 111*a* and 112*a* discharge ink from the nozzles by driving piezoelectric elements. Then, the attraction transporter 120 depicted in FIG. 6 moves downward, and the wiper mechanism 1 moves to the retracted position depicted in FIG. 1. At the retracted position, the wiper 11 desirably has returned to a rear position in the traveling direction D2. when printing is performed, the attraction transporter 120 rises to the vicinity of the printing unit 110; otherwise, the attraction transporter 120 moves down to a standby position.

FIG. 9 is a table illustrating a result of a durability test of the nozzle surface 112*a*-1 for various sizes of the leading-end projecting section 11*c*.

The result of the durability test depicted in FIG. 9 is a result of visual check of the state of deterioration of the nozzle surface 112*c*-1 (ink-repellent film CF) after being wiped 10000 times by the wiper 11 for each of different "leading-end-portion thicknesses [mm]", i.e., thicknesses A of the leading-end projecting section 11*c* depicted in FIG. 7 in the traveling direction 22, and different "leading-end-portion lengths [mm]", i.e., the lengths B of the leading-end projecting section 11*c* in the extension direction D1. This state of deterioration may be judged to have progressed when uneven wear resulting from chattering has occurred due to wiping with poor sliding in the width direction (left-right direction) orthogonal to the traveling direction (D2) of the wiper 11 (front direction) or when uneven wear has occurred in streaks parallel to the traveling direction D2 of the wiper 11, and may be judged not to have progressed when wear has progressed evenly all over without occurrence of uneven wear resulting from chattering or uneven wear in streaks.

Some of thicknesses A of the leading-end projecting section 11*c* of 0.03, 0.04, 0.05, 0.06, 0.07, 0.09, 0.1, 0.12, 0.14, and 0.17 [mm] with some of lengths B of the leading-end projecting section 11*c* of 0.02, 0.05, 0.1, 0.13, 0.15, 0.18, 0.19, 0.2, and 0.3 [mm] provided test results of "○" wherein the nozzle surface 112*a*-1 (ink-repellent film CF) was not deteriorated and test results of "Δ" wherein the nozzle surface 112*a*-1 (ink-repellent film CF) was deteriorated. In FIG. 9, a value of "thickness A/length B" is indicated in parenthesis for each of the situations "○" and "Δ". On the basis of the test result depicted in FIG. 9 and the like, it was found that satisfying a relationship of "thickness A/thickness B≥0.35", e.g., "thickness A/thickness B≥1.0", results in "◯" indicating no deterioration of the nozzle surface 112*a*-1 (ink-repellent film CF). It was also found that the thickness A being 0.07 mm to 0.17 mm and the length B being 0.02 mm to 0.2 mm are more desirable. The length B is far less than the thickness A when "thickness A/length B" exceeds 10. Thus, a relationship of "10.0≥(thickness A/length B)≥0.35" may be satisfied to ensure a region of abutment between the leading end projecting section 11*c* and the nozzle surface 112*a*-1.

The test result depicted in FIG. 9 is one obtained under a condition in which the thickness C of the base section 11*a* is 0.55 mm, the angle θ that the inclined surface 11*b* forms with the extension direction D1 is 60°, the length L1 of the inclined surface 11*b* in the extension direction D1 is 0.25 mm, and the overlapping length L2 of the wiper 11 and the head modules 111*a* and 112*a* is 0.18 mm. It is considered that satisfying the above-described relationship of "10.0≥ (thickness A/length B)≥0.35" can make the pressure of abutment between the leading-end projecting section 11*c* and the nozzle surface 112*a*-1 more even, thereby reducing the occurrence of uneven wear of the nozzle surface 112*a*-1 (ink-repellent film CF). It is considered Flat even when the relationship of "10.0=(thickness A/length. B)≥0.35" is not satisfied, the providing of the leading-end projecting section 11*c* can make the pressure of abutment. between the leading-end projecting section 11*c* and the nozzle surface 112*a*-1 more even.

In the embodiments described so far, the wiper 11 extends toward the inkjet heads 111 and 112 and wipes the nozzle surfaces 112*a*-1 of these inkjet heads. The wiper 11 includes: the base section 11*a* extending in the extension direction D1 of the wiper 11; the inclined surface 11*b* continuous with the base section 11*a* and having, in the traveling direction D2 in which the wiper 11 travels during wiping, a thickness that gradually decreases toward the extension direction D1 (decreased from thickness C to thickness A); and the leading-end projecting section 11*c* having a thickness A less than the thickness of the base section 11*a* (thickness C) and provided at a leading end of the wiper 11 in such a manner as to be continuous with the inclined surface 11*b* and project in the extension direction D1. The wiper mechanism 1 includes the wiper 11, the guide 20 that guides the wiper 11 in the traveling direction D2 during wiping, and the ink receiver 30 that receives ink resulting from the wiping by the wiper 11.

In the meantime, in an aspect (hereinafter referred to as a comparative example) in which the wiper 11 includes, at the leading end thereof, an inclined surface (inclined surface 11*b*), not the leading-end projecting section 11*c*, the thickness of the wiper 11 is gradually decreased toward the leading end so that the pressure of abutment between the wiper 11 and the nozzle surface 112*a*-1 can be reduced; however, as the durability is decreased toward the leading end, there tend to be variations in abutment pressures on the region of abutment between the wiper 11 and the nozzle surface 112*a*-1. In the embodiments, by contrast, the wiper 11 is provided with the inclined surface 11*b* to decrease the abutment pressure, and furthermore, the leading-end projecting section 11*c* continuous with the inclined surface lib is provided at the leading end of the wiper 11, thereby making the abutment pressures and contact states (contact pressure distribution) on the region of abutment between the leading-end projecting section 11*c* of the wiper 11 and the nozzle surface 112*a*-1 (ink-repellent film CF) less likely to exhibit variations. Thus, it is possible to reduce occurrence of uneven wear of the nozzle surface 112*a*-1 resulting from chattering due to wiping with poor sliding in the width direction (left-right direction) orthogonal to the traveling direction D2 of the wiper 11 and occurrence of uneven wear of the nozzle surface 112*a*-1 in streaks parallel to the traveling direction D2 of the wiper 11. Accordingly, the embodiments allow the durability of the nozzle surfaces 112*a*-1 of the inkjet heads 111 and 112 to be enhanced. The entirety of the nozzle surface 112*a*-1 being worn without occurrence of uneven wear will allow the performance of the ink-repellent film CF to be maintained for a long time. In addition, the pressure of abutment between the wiper 11 and the nozzle surface 112*a*-1 is less likely to exhibit variations, and hence reducing the amount of purge ink PI to remain after wiping allows factors that could reduce the wiping quality, such as thickening of the remaining purge ink PI, to be prevented from occurring.

In the embodiments, a relationship of "A/B0≥0.35" is satisfied, where A is the thickness of the leading-end projecting section 11*c*, and B is the length of the leading-end projecting section 11*c* in the extension direction D1. Thus, the leading-end projecting section 11*c* of the wiper 11 can have a moderate durability (strength, toughness), and the nozzle surface 112*a*-1 can be wiped on a narrow region of abutment with even abutment pressures and contact states (contact pressure distribution).

In the embodiments, the inclined surface 11*b* forms an angle θ with the extension direction D1 that is equal to or greater than 45° but less than 90°. Thus, the leading-end projecting section 11*c* of the wiper 11 can have a moderate durability (strength, toughness), and the nozzle surface 112*a*-1 can be wiped on a narrow region of abutment with even abutment pressures and contact states (contact pressure distribution).

Figure 10:
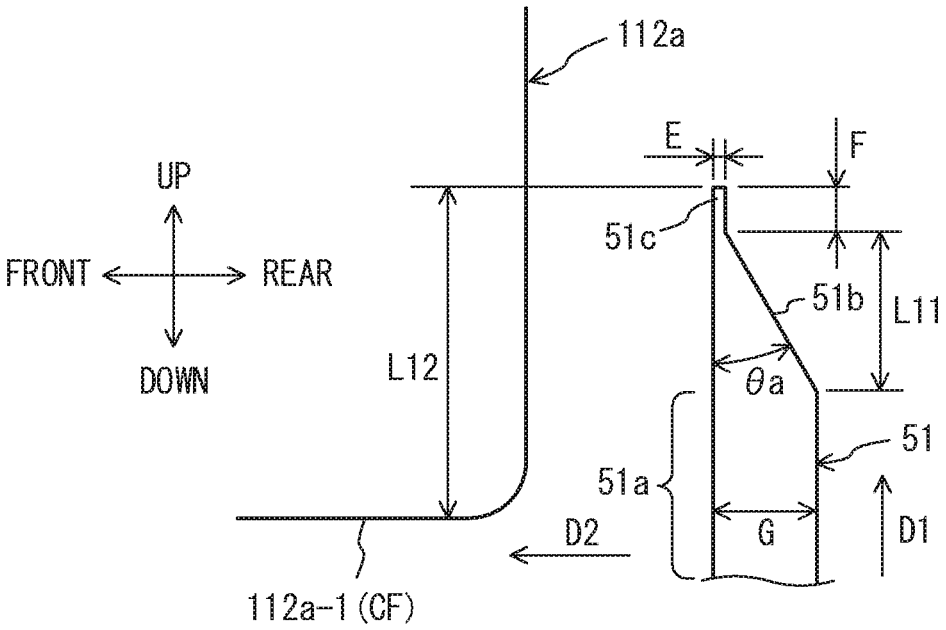
FIG. 10 is an explanatory diagram illustrating the size of a wiper in accordance with another embodiment.

FIG. 10 is an explanatory diagram illustrating the size of a wiper 51 in accordance with a variation.

The wiper 51 in this variation is different from the examples described so far only in that a thickness E of a leading-end projecting section 51*c*, a length F of the leading-end projecting section 51*c*, an angle θa that an inclined surface 51*b* forms with the extension direction D1, and a length L11 of an inclined surface 51*b* are different from the thickness A, length B, angle θ, and length L11 specific to the above-described wiper 11. Accordingly, detailed descriptions of this variation are omitted herein. Note that a base section 51*a* has a thickness G equal to the thickness C, and an overlapping length L12 is equal to the overlapping length L2.

For example, the wiper 51 may be shaped like a rectangular plate and include the base section 51*a*, the inclined surface 51*b*, and the leading-end projecting section 51*c*, which are continuous and arranged in the extension direction D1.

The base section 51*a* extends in the extension direction D1 of the wiper 51. For example, a thickness C that the base section 11*a* has in a traveling direction D2 (frontward) during the wiping by the wiper 51 may be constant (e.g., 0.55 mm) in the extension direction D1.

The inclined surface 51*b* is a flat section having a width in the traveling direction D2 (front direction) that is gradually decreased in the extension direction D1 (decreased from thickness G to thickness F). The angle θa that the inclined surface 51*b* forms with the extension direction D1 is, for example, 30° and thus does not satisfy the above-described relationship of "equal to or greater than 45° butt less than 90°" but does satisfy a relationship of 0°<θa<45'. The inclined surface 51*b* is provided at a rear portion in the traveling direction D2. A length of the inclined surface 51*b* in the extension direction D1 is L11 (e.g., 0.84 mm).

The leading-end projecting section 51*c* is provided at the leading end of the wiper 51 so as to project in the extension direction D1 from the front edge in the traveling direction D2, i.e., from the leading end of the inclined surface 51*b*. The thickness F (e.g., 0.065 mm) of the leading-end projecting section 51*c* in the traveling direction D2 is less than the thickness G of the base section 51*a*. For example, the thickness G may be constant in the extension direction D1.

In this variation, a relationship of "E/F≥0.35" (corresponding to the relationship of "A/B≥0.35") is not satisfied, but a relationship of "0.35>(E/F)>0" is satisfied, where F (e.g., 0.25 mm) is the length of the leading-end projecting section 11*c* in the extension direction D1.

Figure 11:
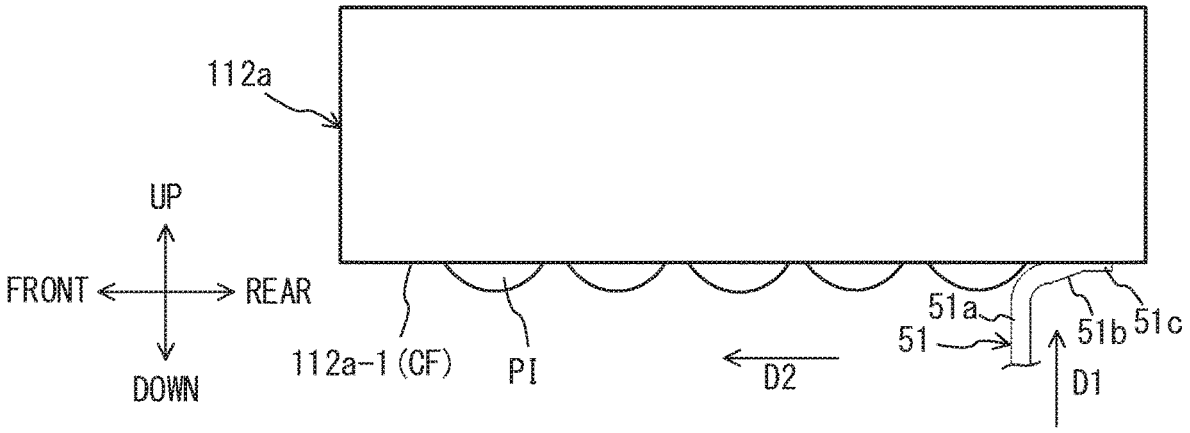
FIG. 11 is an explanatory diagram illustrating a wiper during wiping in another embodiment.

FIG. 11 is an explanatory diagram illustrating the wiper 51 during wiping.

As depicted in FIG. 11, when wiping the nozzle surfaces 112*a*-1 of the head modules 111*a* and 112*a*, the wiper 51 moves in the traveling direction D2 while, as described above, being located above the nozzle surfaces 112*a*-1 of the head modules 111*a* and 112*a* in the extension direction D1 and overlapping these head modules (by the overlapping length L12 depicted in FIG. 10) Accordingly, the wiper 51 moves in the traveling direction D2 with a leading end portion thereof warped backward in the traveling direction D2. In this case, the leading-end projecting section 51*c*, among the other sections of the wiper 51, may abut the nozzle surface 112*a*-1 (ink-repellent film CF).

In this variation, a relationship of "E/F≥0.35" (corresponding to the relationship of "A/B≥0.35") is not satisfied, but a relationship of "0.35>(E/F)>0" is satisfied, where E is the thickness of the leading-end projecting section 51*c*, and F is the length of the leading-end projecting section 51*c* in the extension direction D1. In this variation, the angle θa that the inclined surface 51*b* forms with the extension direction D1 is, for example, 30° and thus does not satisfy the above-described relationship of "equal to or greater than 45° but less than 90°" (satisfies a relationship of 0°<θa<45°). Accordingly, in the variation in which neither the relationship of "E/F≥0.35" nor the relationship of "45≤θa<90" is satisfied (or one of these relationships is not satisfied), the wiper 51 can be provided with the inclined surface 51*b* to decrease the abutment pressure, and furthermore, the leading-end projecting section 51*c* continuous with the inclined surface 51*b* can be provided at the leading end of the wiper 51, thereby making the abutment pressures and contact states (contact pressure distribution) on the region of abutment between the leading-end projecting section 51*c* of the wiper 51 and the nozzle surface 112*a*-1 (ink-repellent film CF) less likely to exhibit variations. Thus, this variation allows the durability of the nozzle surfaces 112*a*-1 of the inkjet heads 111 and 112 to be enhanced.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from, the (list of the invention. The following indicates, as appendixes, the inventions recited in the claims of the Japanese application as originally filed.

According to one aspect, the application relates to a wiper that extends toward an inkjet head and wipes a nozzle surface of the inkjet head, the wiper comprising:

a base section extending in an extension direction of the wiper;

an inclined surface continuous with the base section and having, in a direction in which the wiper travels during wiping, a thickness that gradually decreases toward the extension direction; and a leading-end projecting section thinner than the base section and provided at a leading end of the wiper in such a manner as to be continuous with the inclined surface and project in the extension direction.

According to another aspect, in the wiper

A/B≥0.35 is satisfied, where A is a thickness of the leading-end projecting section, and B is a length of the leading-end projecting section in the extension direction.

According to another aspect, in the wiper the inclined surface forms an angle θ with the extension direction that is equal to or greater than 45° but less than 90°.

According to another aspect, a wiper mechanism. comprising:

a wiper that extends toward an inkjet head and wipes a nozzle surface of the inkjet head;

a guide that guides the wiper in a traveling direction during wiping; and an ink receiver that receives ink resulting from wiping by the wiper, wherein the wiper includes a base section extending in an extension direction of the wiper, an inclined surface continuous with the base section and having, in a direction in which the wiper travels during wiping, a thickness that gradually decreases toward the extension direction, and a leading-end projecting section thinner than the base section and provided at a leading end of the wiper in such a manner as to be continuous with the inclined surface and project in the extension direction.

What is claimed is:

1. A wiper that extends toward an inkjet head and wipes a nozzle surface of the inkjet head, the wiper comprising:

a base section extending in an extension direction of the wiper;

an inclined surface continuous with the base section and having, in a direction in which the wiper is configured to travel during wiping of the nozzle surface of the inkjet head, a thickness that gradually decreases toward the extension direction; and a leading-end projecting section thinner than the base section and provided at a leading end of the wiper in such a manner as to be continuous with the inclined surface and project in the extension direction.

2. The wiper of claim 1, wherein the inclined surface forms an angle θ with the extension direction that is equal to or greater than 45° but less than 90°.

3. A wiper that extends toward an inkjet head and wipes a nozzle surface of the inkjet head, the wiper comprising:

a base section extending in an extension direction of the wiper;

an inclined surface continuous with the base section and having, in a direction in which the wiper travels during wiping, a thickness that gradually decreases toward the extension direction; and a leading-end projecting section thinner than the base section and provided at a leading end of the wiper in such a manner as to be continuous with the inclined surface and project in the extension direction, wherein A/B≥0.35 is satisfied, where A is a thickness of the leading-end projecting section, and B is a length of the leading-end projecting section in the extension direction.

4. The wiper of claim 3, wherein the inclined surface forms an angle θ with the extension direction that is equal to or greater than 45° but less than 90°.

5. A wiper mechanism comprising:

a wiper that extends toward an inkjet head and wipes a nozzle surface of the inkjet head;

a guide that guides the wiper in a traveling direction during wiping; and an ink receiver that receives ink resulting from wiping by the wiper, wherein the wiper includes a base section extending in an extension direction of the wiper, an inclined surface continuous with the base section and having, in a direction in which the wiper is configured to travel during wiping of the nozzle surface of the inkjet head, a thickness that gradually decreases toward the extension direction, and a leading-end projecting section thinner than the base section and provided at a leading end of the wiper in such a manner as to be continuous with the inclined surface and project in the extension direction.

6. The wiper mechanism of claim 5, wherein

A/B≥0.35 is satisfied, where A is a thickness of the leading-end projecting section, and B is a length of the leading-end projecting section in the extension direction.

7. A wiper that extends toward an inkjet head and wipes a nozzle surface of the inkjet head, the wiper comprising:

a base section extending in an extension direction of the wiper;

an inclined surface continuous with the base section and having, in a traveling direction in which the wiper is configured to travel during wiping of the nozzle surface of the inkjet head, a thickness that gradually decreases toward the extension direction; and a leading-end projecting section thinner than the base section and provided at a leading end of the wiper in such a manner as to be continuous with the inclined surface and project in the extension direction from a front edge of the wiper in the traveling direction.

8. The wiper of claim 7, wherein

A/B≥0.35 is satisfied, where A is a thickness of the leading-end projecting section, and B is a length of the leading-end projecting section in the extension direction.

9. The wiper of claim 8, wherein the inclined surface forms an angle θ with the extension direction that is equal to or greater than 45° but less than 90°.

10. The wiper of claim 7, wherein the inclined surface forms an angle θ with the extension direction that is equal to or greater than 45° but less than 90°.

11. A wiper mechanism comprising:

the wiper according to claim 7 that extends toward the inkjet head and wipes the nozzle surface of the inkjet head;

a guide that guides the wiper in the traveling direction during wiping; and an ink receiver that receives ink resulting from wiping by the wiper.

12. The wiper mechanism of claim 11, wherein

A/B≥0.35 is satisfied, where A is a thickness of the leading-end projecting section, and B is a length of the leading-end projecting section in the extension direction.

* * * * *